US006679358B2

(12) United States Patent
Be

(10) Patent No.: US 6,679,358 B2
(45) Date of Patent: Jan. 20, 2004

(54) BAG WITH INTEGRAL BOTTOM CASE

(76) Inventor: Sung Hoan Be, 877-Kumdan-Dong, Buk-Gu, Taegu (KR)

( * ) Notice: Subject to any disclaimer, the term of this patent is extended or adjusted under 35 U.S.C. 154(b) by 0 days.

(21) Appl. No.: 10/126,164

(22) Filed: Apr. 18, 2002

(65) Prior Publication Data

US 2003/0196860 A1 Oct. 23, 2003

(51) Int. Cl.[7] ..... A45C 5/14; A45C 13/02; A45C 13/26; A45C 13/36

(52) U.S. Cl. ..... 190/18 A; 190/24; 190/37; 190/109; 190/115; 190/123; 190/127; 280/655.1

(58) Field of Search ..... 190/18 A, 24, 190/39, 109, 119, 122, 124, 127; 280/655.1

(56) References Cited

U.S. PATENT DOCUMENTS

| | | | | |
|---|---|---|---|---|
| 4,311,222 A | * | 1/1982 | Castanier | 190/18 A |
| 4,621,404 A | * | 11/1986 | Browning | 190/127 X |
| 4,712,657 A | * | 12/1987 | Myers et al. | 190/28 |
| 5,524,737 A | * | 6/1996 | Wang | 190/127 X |
| 5,529,156 A | * | 6/1996 | Yang | 190/127 X |
| 6,260,680 B1 | * | 7/2001 | Lin | 190/127 X |
| 6,325,189 B1 | * | 12/2001 | King et al. | 190/903 X |

FOREIGN PATENT DOCUMENTS

| | | | |
|---|---|---|---|
| DE | 2914023 | * 10/1980 | 190/127 |
| DE | 4221215 | * 1/1994 | 190/102 |
| WO | 9318684 | * 9/1991 | 190/18 A |
| WO | 9219122 | * 11/1992 | 190/115 |

* cited by examiner

*Primary Examiner*—Sue A. Weaver
(74) *Attorney, Agent, or Firm*—Jacobson Holman PLLC

(57) ABSTRACT

A bag equipped with a bottom case, which is comprised of a bottom plate and a side peripheral wall and is integrally provided at its inner or outer surface with handle holding members and at its outer surface with caster mounting members, and which is coupled to an upper case made of fabric material or synthetic resin, is disclosed. The bottom case is detachably coupled to an upper case to allow only one case of both cases to be separated from the other case and to be cleaned or replaced with a new one. The bottom case is provided at its side wall with a reinforcing frame to prevent the side wall from being squeezed or broken. The bottom case is provided with handle mounting members to be integrally formed thereto or to be separated therefrom so as to diversify design and appearance of the bag.

14 Claims, 13 Drawing Sheets

BAG WITH INTEGRAL BOTTOM CASE

BACKGROUND OF THE INVENTION

1. Field of the Invention

The present invention relates to a bag, and more particularly to a bag equipped with a bottom case, which is comprised of a bottom plate and a side peripheral wall and which is provided at its inner or outer surface with handle holding members and at its outer surface with caster mounting members, both which are injection molded therewith, in which the bottom case is coupled to an upper case made of fabric material or synthetic resin.

2. Description of the Prior Art

Among conventional kit bags and bowling bags, there is a bag integrally formed with a bottom case, which is designed such that the bottom case is comprised of a bottom plate and a side wall integrally formed at a periphery of the bottom plate to afford a receiving space therein, and is integrally formed at its outer surface with caster mounting members for supporting fixed or rotatable casters and at its inner surface with handle holding members by an injection molding process, and the bottom case is coupled to an upper case. Such bags are disclosed in Korean Utility Model No. 102353, Korean Patent Application No. 2001-0009210 and U.S. Pat. No. 5,607,175.

Bags disclosed in the above cited applications and patent have disadvantages as follows.

Since an upper case of the bag is usually made of cloth material and coupled to a side wall of a bottom case by sewing, when any one of the bottom case and the upper case is dirtied owing to its prolonged use, both the bottom and upper cases must be cleaned, and when any one of the bottom and upper case is damaged or broken, the bag itself must be discarded.

Furthermore, where the bottom case is increased in its height at its side wall without compensation of its thickness corresponding to the increment of height and coupled to an upper case, the side wall of the bottom case is easily squeezed or deformed.

To overcome this problem, the applicant had previously filed a patent application, in which protruded wall portions are formed at a side wall of a bottom case at a certain spacing such that fitting grooves are defined between the protruded wall portions and the side wall, and a shock absorber member is fitted in the grooves, thereby enhancing strength of the bag and preventing damage or breakage of articles received in the bag.

However, the bag proposed by the applicant has disadvantages in that the bottom case of the bag becomes complicated in structure and reduces productivity, and suffering early wear of the shock absorber.

Moreover, the bag is configured such that caster mounting members are provided at an outer surface of the bottom case. In this case, to facilitate attachment of casters, additional stoppers are produced and assembled to the caster mounting members followed by attachment of casters. However, such production and assembly of additional stoppers causes the entire manufacturing process to be complicated, resulting in reduction of productivity.

According to the bag disclosed in the application of the applicant, handle holes and circular or polygonal handle holding pipes are integrally formed at the bottom case so that an extensible handle can be inserted into the handle holding pipes through the handle holes. Where an extensible handle is assembled to a bottom case of a bag as in this case, there is a limit to various modifications to be made according to various applications of the bag. For example, a receiving space of the bag is reduced, and there are many restrictions in enlargement of the space and variety of designs.

SUMMARY OF THE INVENTION

Accordingly, the present invention has been made keeping in mind the above problems occurring in the prior art, and an object of the present invention is to provide a bag having a bottom case, which can be detachably coupled to an upper case to allowing only one case of both cases to be separated from the other case to be cleaned or replaced with new one.

Another object of the present invention is to provide a bag having a bottom case, which is provided at its side wall with a reinforcing frame to prevent the side wall from being squeezed or broken.

A further object of the present invention is to provide a bag having a bottom case, which is provided with handle mounting members to be integrally formed thereto or to be separated therefrom so as to diversify design and appearance of the bag.

In order to accomplish the above object, the present invention provides a bag comprising: a bottom case including handle holding members, caster mounting members and a side wall of a certain height, all of which are integrally formed therewith; an extensible handle adapted to be held by the handle holding member; two or more casters coupled to the caster mounting member; and an upper case detachably coupled to the bottom case by means of a slide fastener.

The bag may include a binding strip connected at its opposite ends to the bottom case and the upper case so as to share load acting on the slide fastener.

The bottom case may be provided at its inner surface with protruded wall portions such that fitting grooves are formed between the side wall and the protruded wall portions, in which a reinforcing frame made of metal or synthetic resin having a plurality of holes are fitted, the reinforcing frame being fixedly attached to the side wall by means of screws, thereby providing structural stability to the side wall.

The reinforcing frame may be provided with a reinforcing sub-frame and a partition so as to improve structural stability of the reinforcing frame and to provide various receiving spaces.

The caster mounting members may be integrally formed with stoppers and provided at an outer surface of the bottom case, and the bottom case is integrally formed at its outer surface with caster frames.

Each of the handle holding members may be a polygonal pipe segment such that its outer surface portion is opened and a spacing defined between the opened ends is smaller than a spacing defined between its root walls.

The handle holding members may be integrally formed at an inner surface of the bottom case.

The bottom case may be formed at its front side wall with handle holes, and the bottom case may be formed at both sides of a lateral middle line and at both sides of a rear end with front and rear pairs of handle holder holes, wherein the bottom case is formed with screw holes such that the screw holes are positioned between the front pair of handle holder holes and between the rear pair of handle holder holes, respectively.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
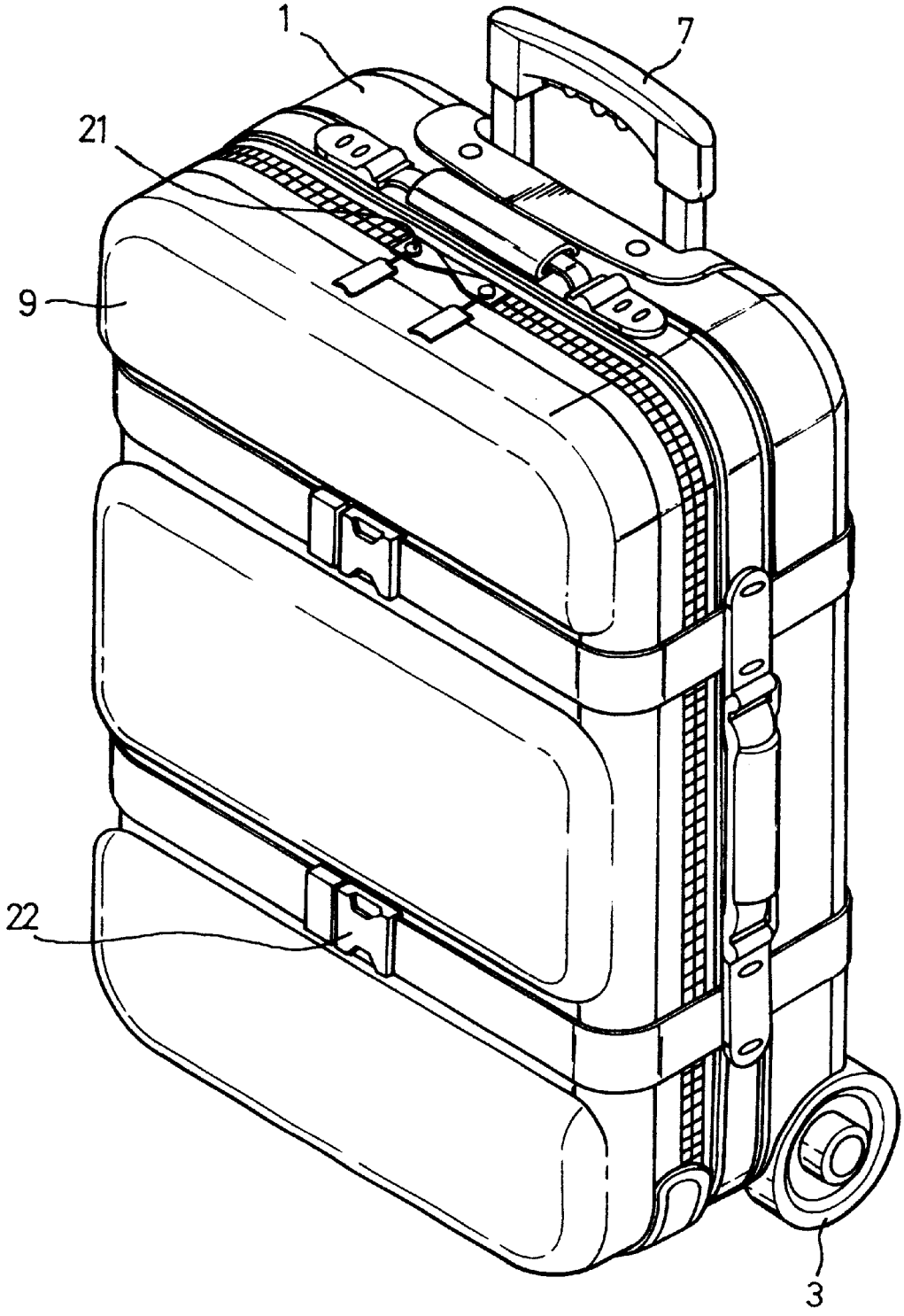
FIG. 1 is a perspective view showing a bag having a bottom case according to the present invention.
Figure 2:
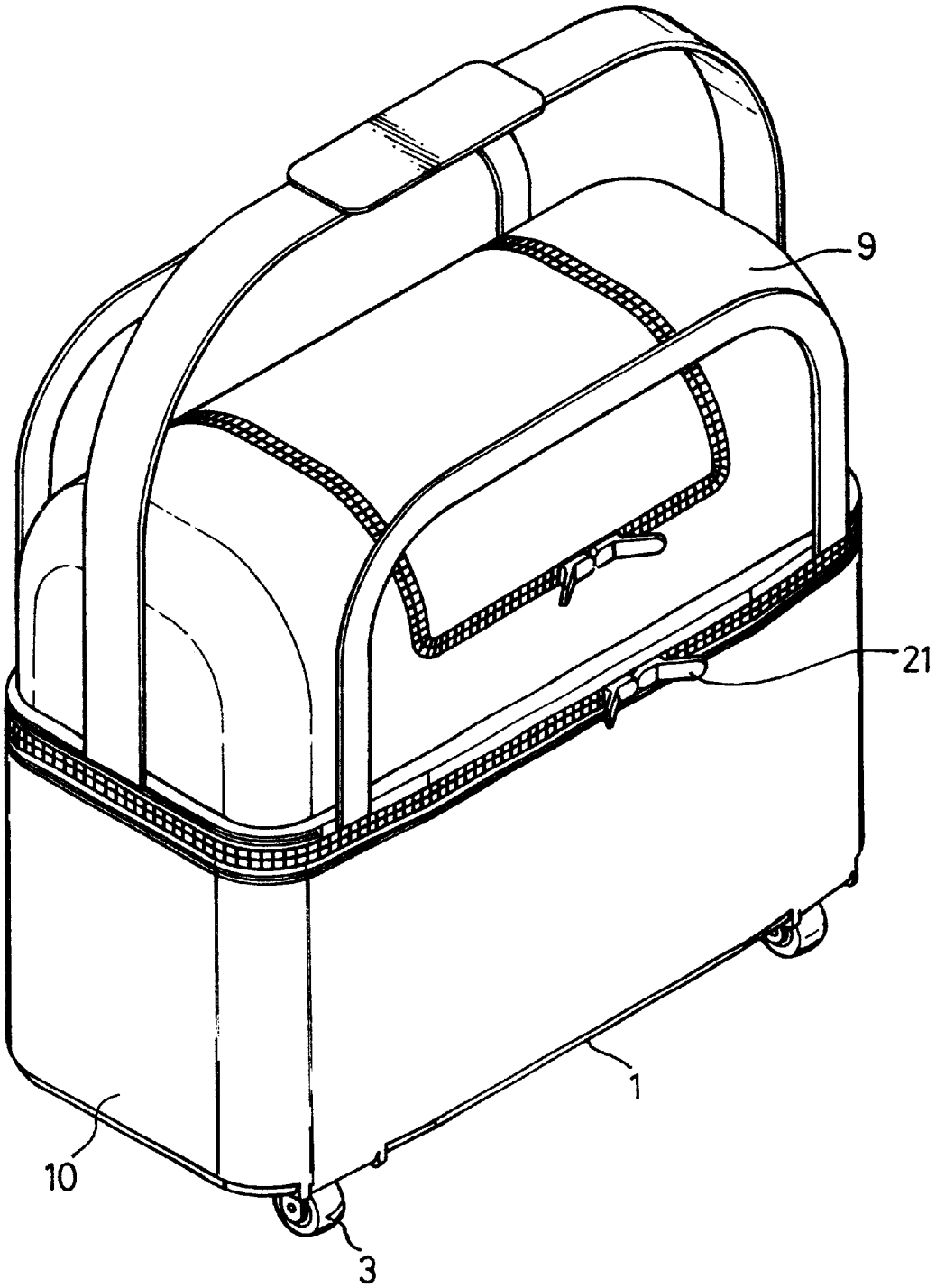
FIG. 2 is a perspective view showing a bag according to the present invention, in which a bottom case is adapted to be coupled to an upper case by means of a slide fastener.
Figure 3:
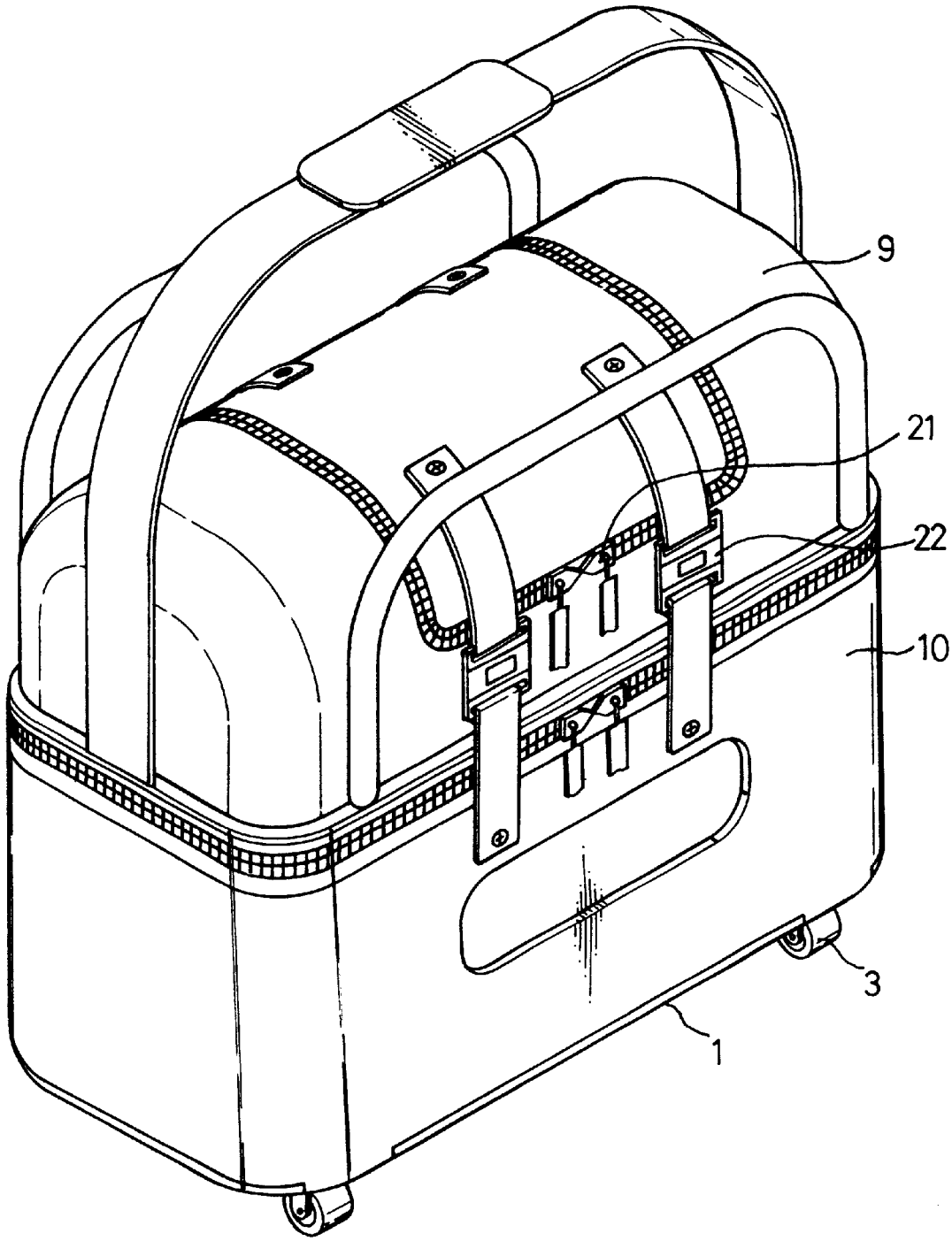
FIG. 3 is a perspective view showing a bag according to the present invention, with binding strips connected to a bottom case and an upper case.
Figure 4:
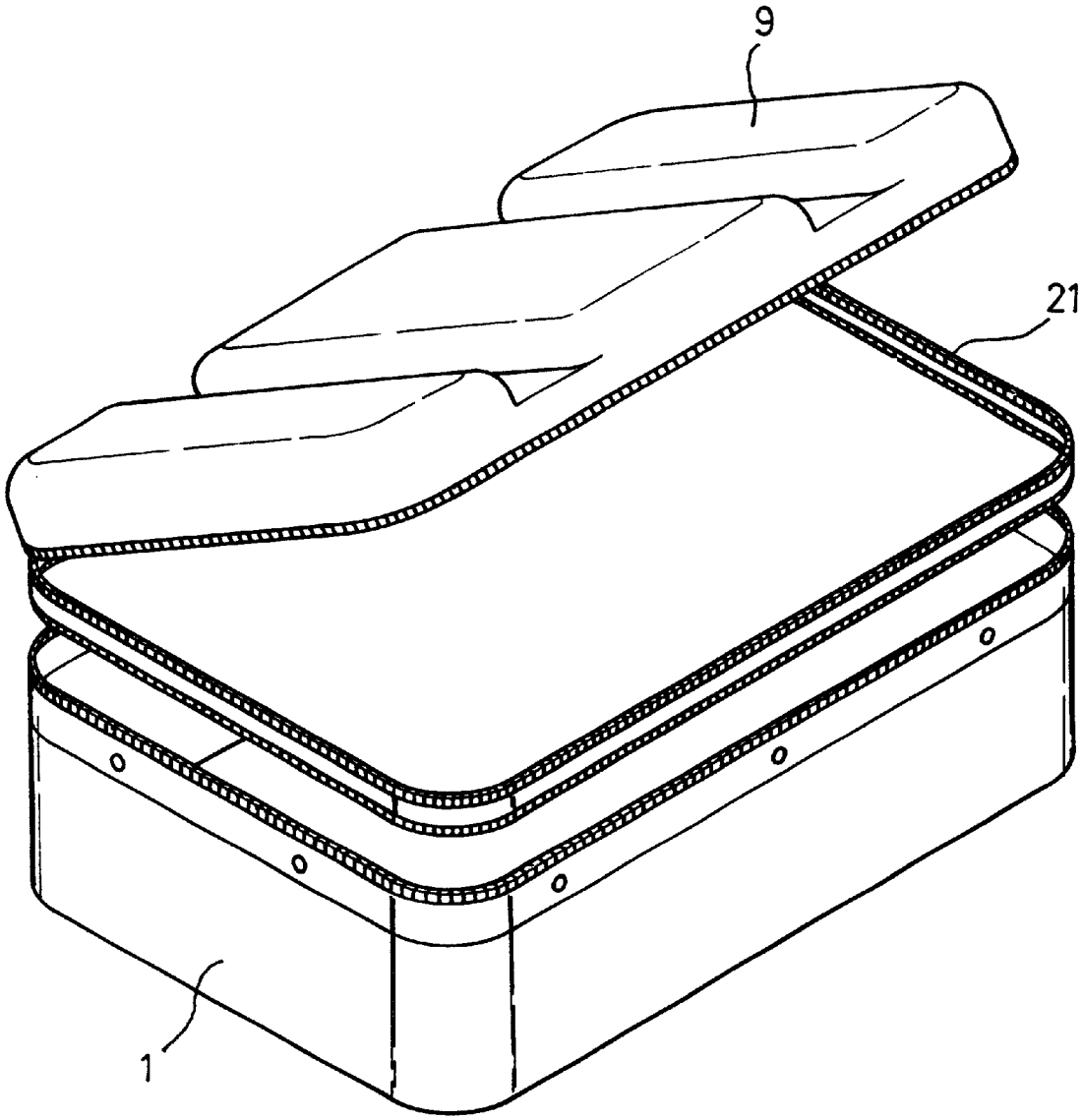
FIG. 4 is a perspective view showing a bag according to the present invention, in which a bottom case is adapted to be coupled to an upper case by means of a slide fastener with the upper case open.
Figure 5:
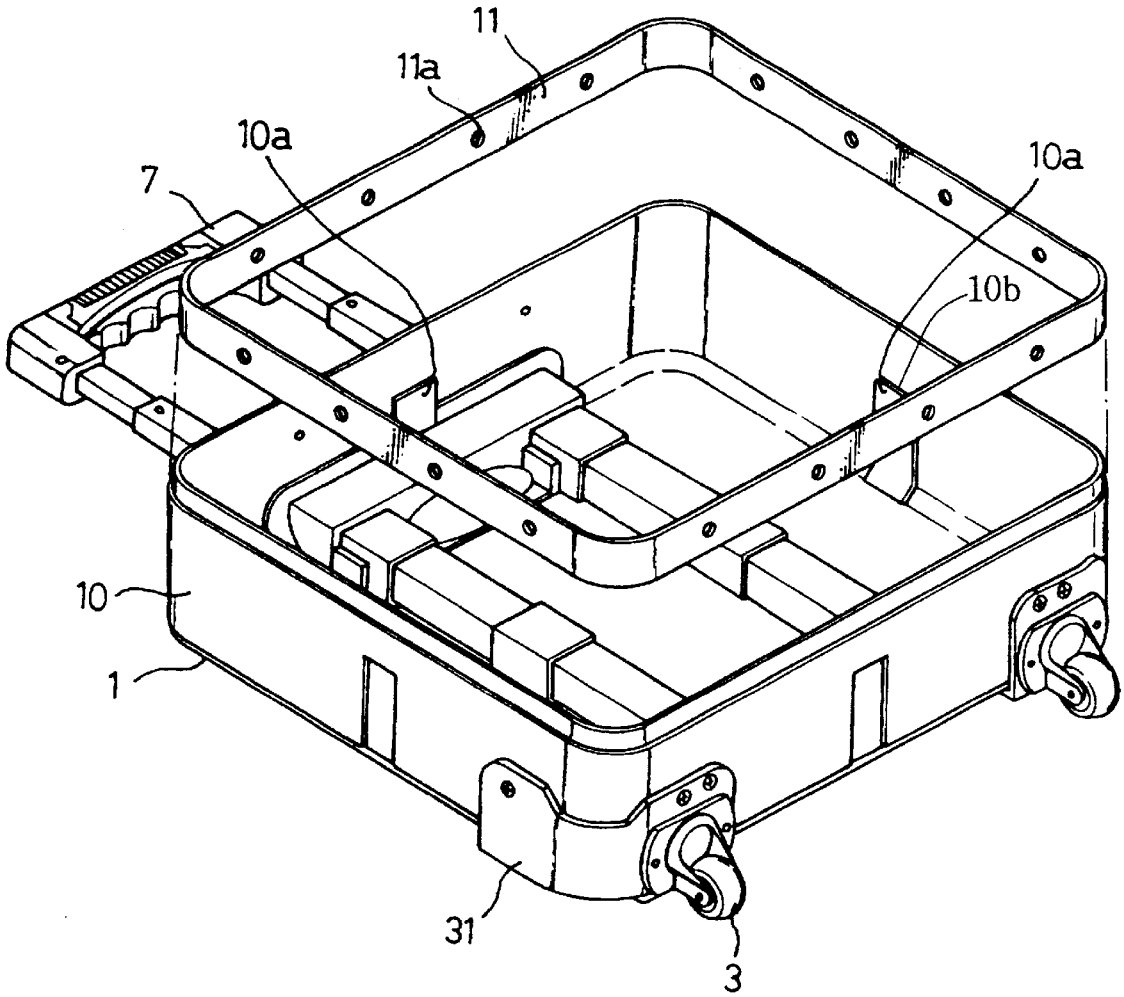
FIG. 5 is a perspective view showing a reinforcing frame to be fitted in a side wall of a bottom case according to the present invention.
Figure 6:
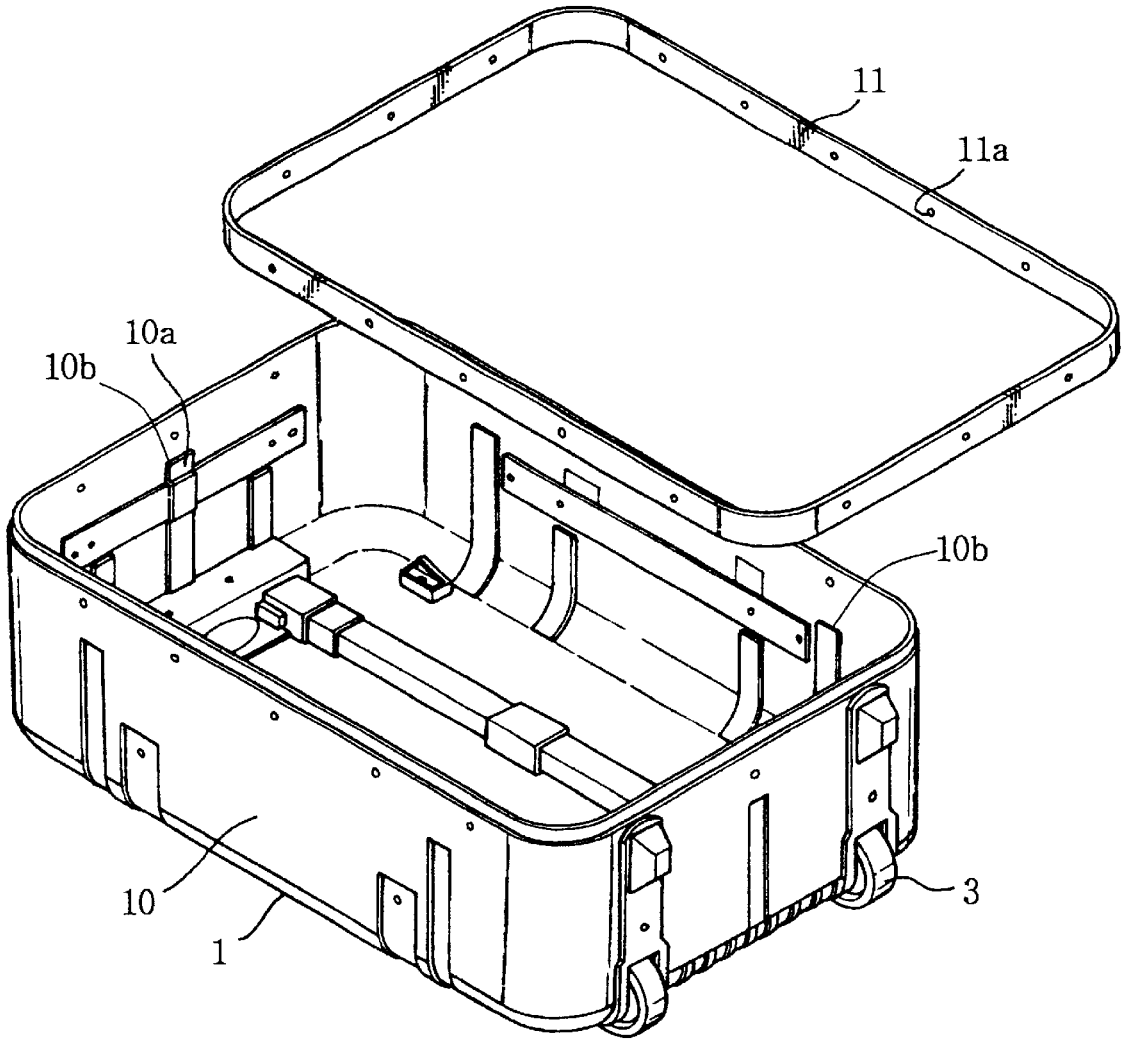
FIG. 6 is a perspective view of an embodiment of a reinforcing frame to be attached to a bottom case according to the present invention.
Figure 7:
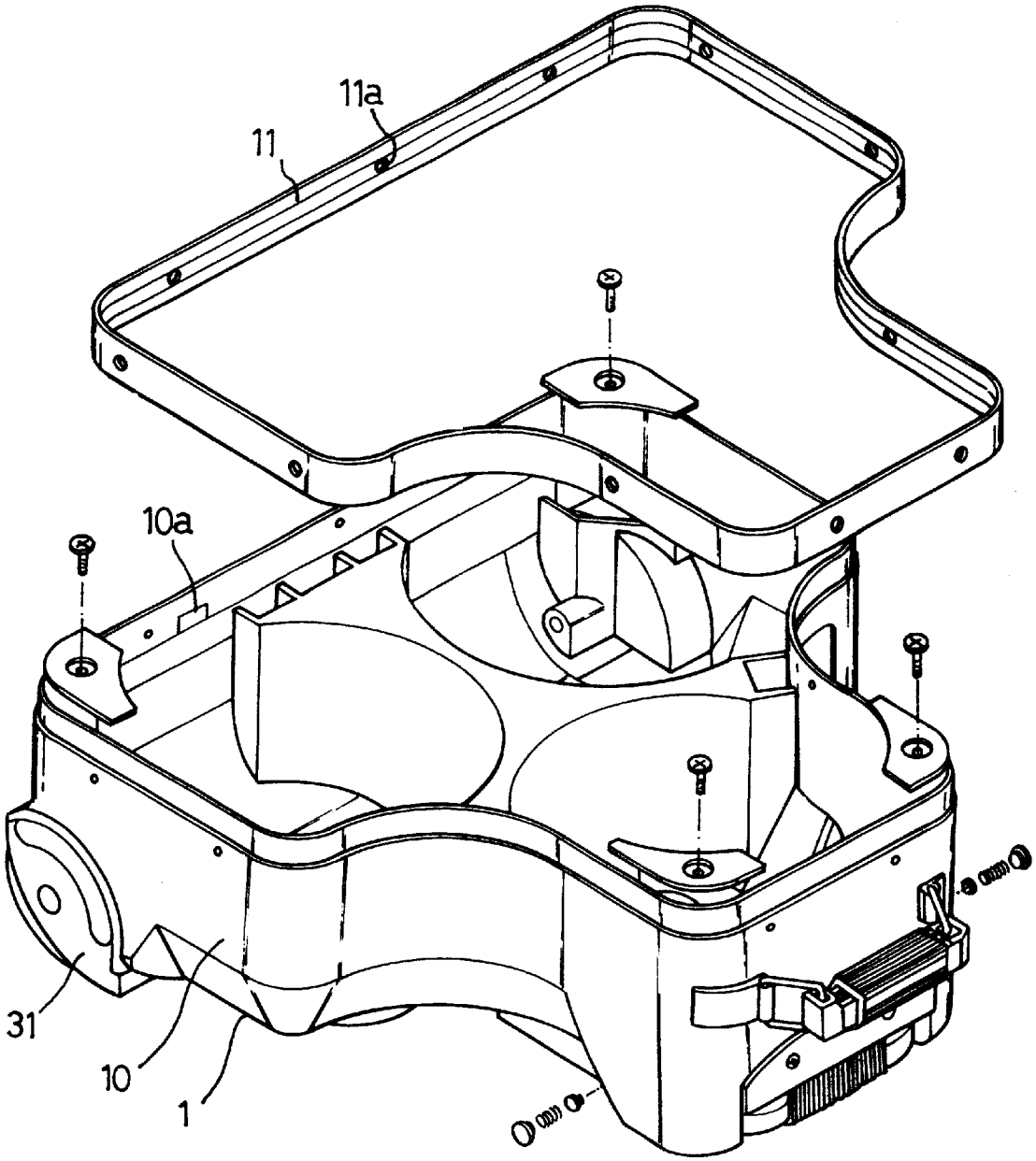
FIG. 7 is a perspective view of another embodiment of a reinforcing frame to be attached to a bottom case according to the present invention.

This invention will be described in further detail by way of example with reference to the accompanying drawings.

FIGS. 1 to 5 show a bag with integral bottom case according to the present invention. The bottom case 1 is integrally formed at its periphery with a side wall 10. An upper case 9 is coupled to the bottom case 1 by sewing. The bottom case is provided at its inner surface with a plurality of handle holding members for holding an extensible handle 7 and at its rear outer surface with caster mounting members 31 for supporting casters 3. The extensible handle 7 is received in the handle holding members, and the casters are fixed to the caster mounting members. The upper case 9 is detachably coupled to the bottom case 1 by means of a slide fastener 21.

To diminish load acting on the slide fastener 21, strips 22 are tightened around the bottom case 1, the side wall 10 and the upper case 9.

To enhance structural stability of the side wall 10 of the bottom case 1, the side wall 10 is provided at its inner surface with protruded wall portions 10*a* integrally injection molded therewith. Formed between the side wall 10 and the protruded wall portions 10*a* are a fitting groove in which a reinforcing frame 11 made of metal or synthetic resin material having a plurality of holes 11*a* is fitted. After being fitted in the fitting groove, the reinforcing frame 11 is fixed thereto by screws.

Figure 8A:
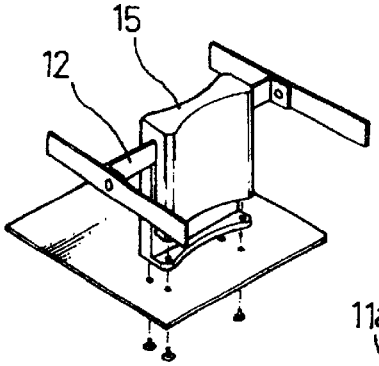
FIG. 8A is an exploded perspective view showing a reinforcing sub-frame with a partition attached to a reinforcing frame according to the present invention.
Figure 8B:
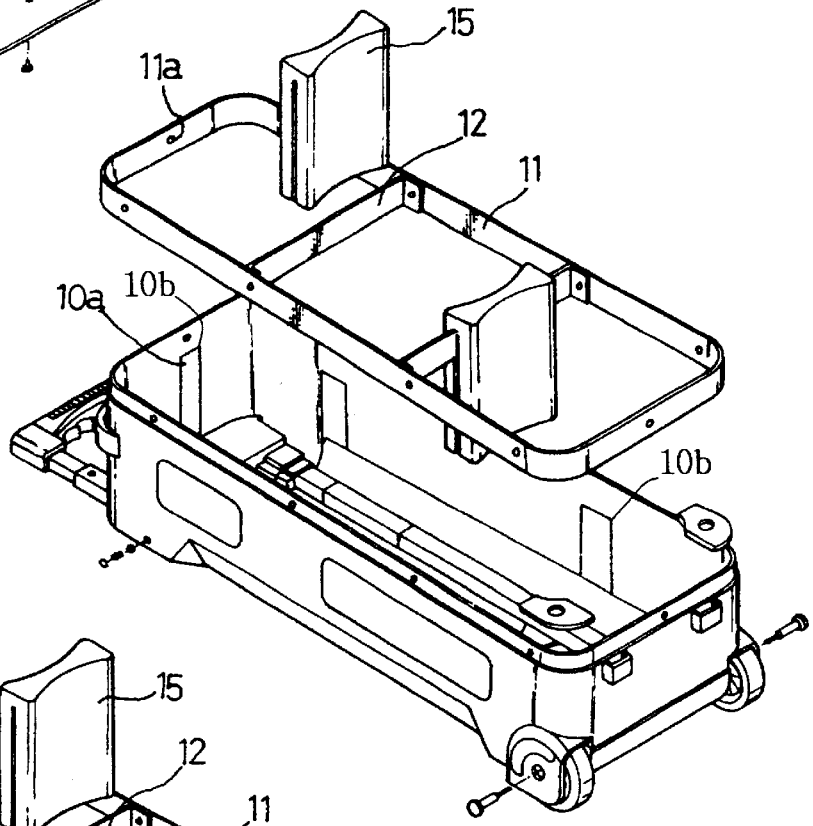
FIGS. 8B and 8C are exploded perspective views showing reinforcing sub-frames attached in various positions along a reinforcing frame according to the present invention.
Figure 8C:
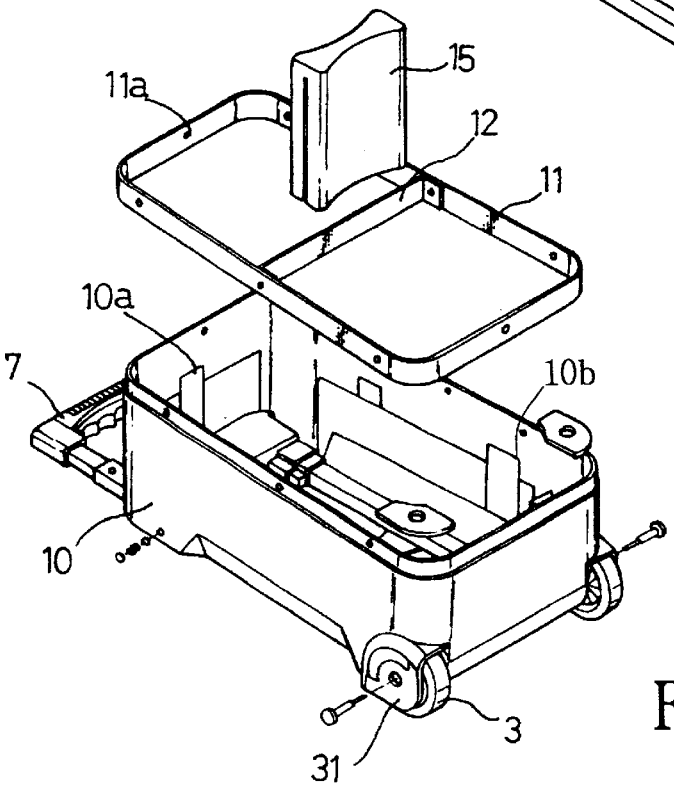

To enhance structural stability of the side wall 10 and the reinforcing frame 11 and to provide various receiving compartments, a plurality of lateral reinforcing bars 12 and partitions 15 are provided in the reinforcing frame 11, as shown in FIG. 8.

Figure 9:
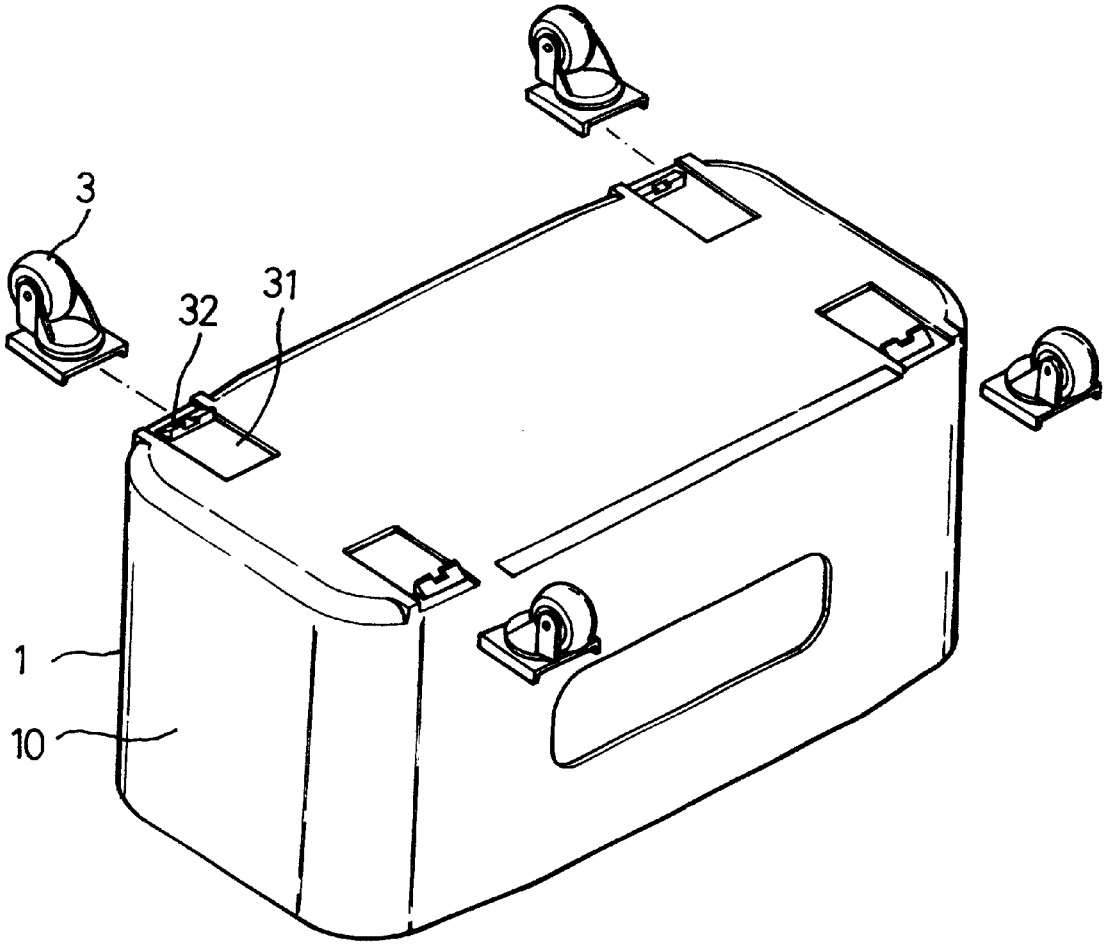
FIG. 9 is an exploded perspective view showing a bottom case on which caster mounting members integrally formed with stoppers are assembled.
Figure 10:
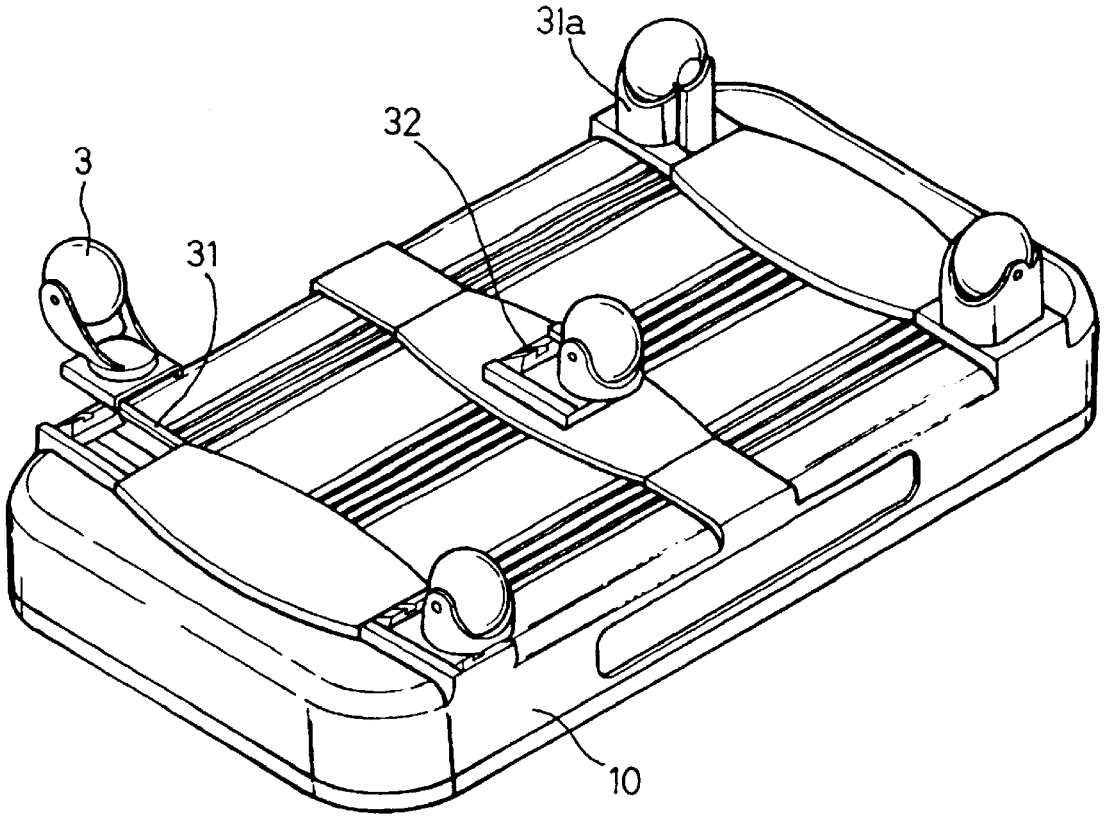
FIG. 10 is a perspective view showing a bottom case on which caster mounting members integrally formed with stoppers and caster frames are assembled.

To attach the fixed or rotatable casters 3 to the outer surface of the bottom case 1, the caster mounting members 31 comprised of integral stoppers 32, and caster frames 31*a* are integrally formed with the bottom case 1, as shown in FIGS. 9 and 10.

Figure 11:
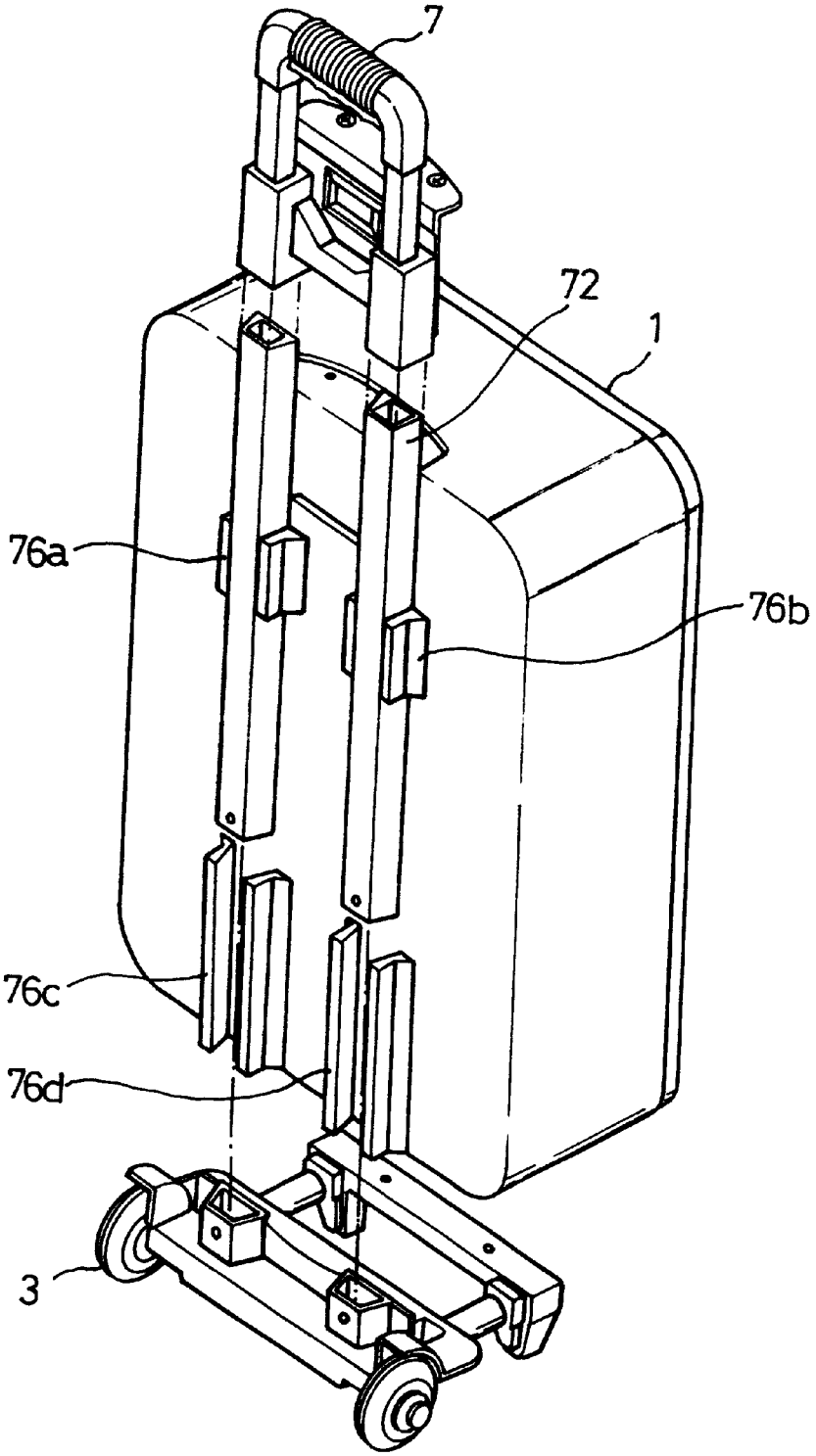
FIG. 11 is a perspective view showing a bottom case, at an outer surface of which handle holding members are integrally formed.

The bottom case 1 is provided at its inner or outer surface with the handle holding members 76*a*, 76*b*, 76*c* and 76*d* made of square pipe segments, which are integrally formed with the bottom case 1 and each of which becomes narrow toward its end, as shown in FIG. 11.

Figure 13C:
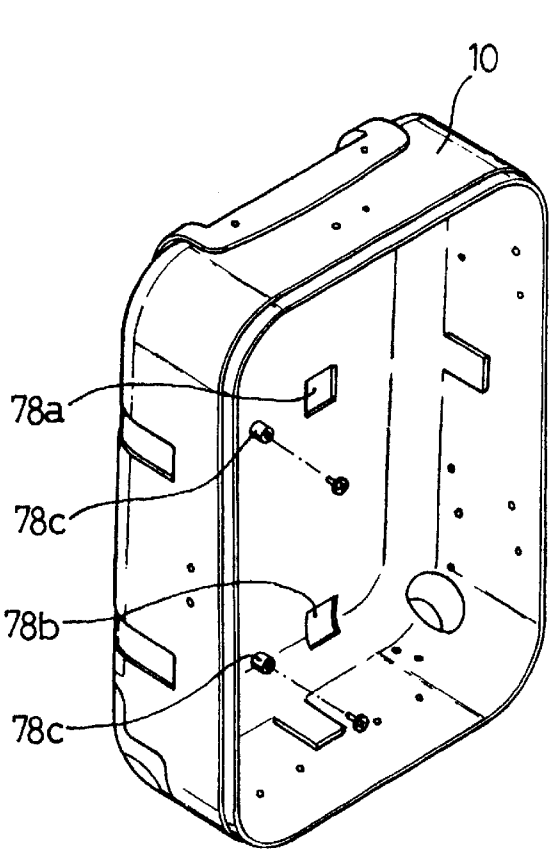
FIG. 13C is an exploded inner perspective view of the bottom case as made to accommodate the handle holder bars.
Figure 13B:
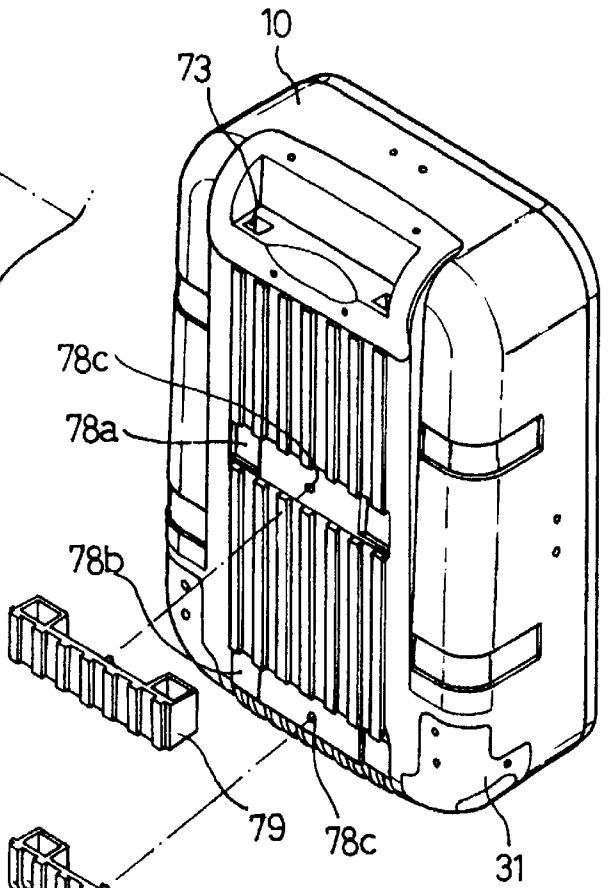
FIG. 13B is an exploded perspective view showing a bottom case, to an outer surface of which handle holder bars of an alternative embodiment of the present invention are attached.
Figure 13A:
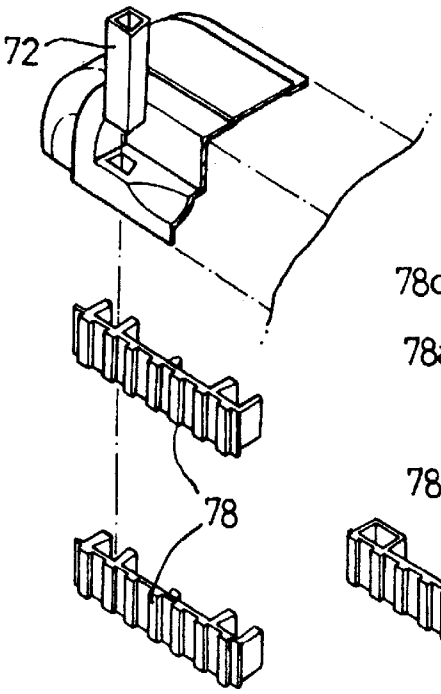
FIG. 13A is an exploded perspective view showing a partial view of a bottom case with handle holder bars according to one embodiment of the present invention.

Alternatively, the extensible handle 7 can be mounted on the bottom case 1 as follows, as shown in FIG. 13. The bottom case 1 is formed at its front portion with handle holes 73, and formed at both sides of a lateral middle line and at both sides of a rear end with handle holder holes 78*a* and 78*b*. Screw holes 78*c* are formed at the bottom case 1 such that they are positioned between the pair of handle holder holes 78*a* and between the pair of handle holder holes 78*b*. Handle holder bars 78 and 79 are attached to the bottom case 1 such that projected holders integrally formed at opposite ends thereof are inserted into the pairs of handle holder holes 78*a* and 78*b*. Each of the projected holders becomes narrow toward its end. Thereafter, the handle holder bars 78 and 79 are fixedly attached to the bottom case 1 by tightening screws through the screw holes 78*c*.

As described above, the bag according to the present invention comprises a bottom case 1, casters 3, an extensible handle 7 and an upper case 9.

Main features of the bag according to the present invention can be classified as follows.

1. coupling of a bottom case 1 and an upper case 9
2. reinforcement of a side wall 10 of a bottom case 1
3. mounting of a fixed or rotatable casters on a bottom case 1
4. installation of an extensible handle 7 to a bottom case A bag with bottom case according to the present invention will now be described in detail according to the above features.

1. Coupling of a Bottom Case 1 and an Upper Case 9 (See FIGS. 1 to 4)

In general, an integral bottom case 1 and an upper fabric case 9 are coupled to each other by sewing to integrate the both cases. Therefore, the bottom case 1 and the upper case 9 cannot be separated from each other.

According to the present invention, a slide fastener 21 consisting of a pair of slide fastener halves are attached to an upper edge of the side wall 10 of the bottom case 1 and a lower edge of the upper case 9, so that when any one of the bottom case 1 and the upper case 9 is broken or dirtied, the bottom case 1 and the upper case 9 can be separated from each other to permit the broken or dirtied case to be replaced with a new one or to be cleaned.

In addition, when the bag receives heavy contents such as bowling balls, an excessive load is applied to the slide fastener 21 connecting the bottom case 1 and the upper case 9, thereby inducing easy breakage of the slide fastener 21. For preventing such breakage of the slide fastener, a plurality of buckle type strips 22 are connected to the bottom case 1 and the upper case 9, thereby achieving easy and reliable coupling of the bottom case 1 and the upper case 9.

2. Reinforcement of a Side Wall 10 of a Bottom Case 1 (See FIGS. 5 to 8)

This is intended to prevent decrease of rigidity of the side wall 10 when the height of the side wall 10 is increased. To this end, the side wall 10 of the bottom case 1 is injection molded together with the protruded wall portions 10*a* such that seating grooves 10*b* are formed between the side wall 10 and the protruded wall portions 10*a*, in which the reinforcing frame 11 is to be fitted.

The reinforcing frame 11, which is made of synthetic resin or metal, is produced to coincide with the shape of the bottom case 1. The reinforcing frame 11 is formed with a plurality of holes 11*a*, so that the reinforcing frame 11 is fixedly attached to the inner surface of the bottom case 1 by screws after being seated in the seating groove 10*b*. Since seating grooves 10*b* are formed between the bottom case 1 and the protruded wall portions 10*a* in the above way, the reinforcing frame 11 is adjusted at a constant level when the reinforcing frame 11 is fitted into the side wall 10.

A thickness, a width and a shape of the reinforcing frame 11 can be properly changed in accordance with a height, a thickness and a shape of the side wall 10.

An internal space of the bottom case 1 is required to be changed, i.e., to be partitioned according to use of the bag and contents to be received therein. To this end, proper numbers of reinforcing bars 12 are coupled to the reinforcing frame 11, and partitions 15, each of which has a fitting slit, are coupled to the reinforcing bars 12 such that the reinforcing bars 15 are inserted in the fitting slits of the partitions 15. As a result, the internal space of the bottom case 1 can be divided into compartments having desired sizes and shapes.

3. Mounting of a Fixed or Rotatable Casters on a Bottom Case 1 (See FIGS. 9 and 10)

Mounting of casters on the bottom case 1 can be variously fulfilled according to use and a shape of the bag. In a commonly used bag, the bag is provided at an outer surface of a bottom case with a pair of rotatable casters and a pair of fixed casters. In this case, the term "rotatable caster" means that a shaft supporting the caster is able to rotate about a supporting point of the bottom case, as well as that the caster is able to rotate about its axis, while the term "fixed caster" means that a shaft supporting the caster is not able to rotate about a supporting point of the bottom case but the caster is able to rotate its axis. To mount the casters 3 on the bottom case 1, caster mounting members 31 having stoppers 32 integrally formed therewith are integrally formed at the bottom case 1, and the casters 3 are coupled to the caster mounting members 31, respectively.

The caster mounting members 31 equipped with the stoppers 32, which enable the casters 3 to be coupled to the bottom case 1, are commonly used as fittings of bags. By applying such caster mounting members 31 to mounting of casters on bottom cases, it is possible to omit procedures of separately producing the stoppers 32 and coupling them to the caster mounting members 31, thereby enhancing productivity.

In the case of the fixed casters, the fixed casters may be mounted on the bottom case 1 such that caster frames 31*a* are integrally formed with the bottom case 1, and the casters are fitted in the caster frames 31*a*, as shown in FIG. 10. Accordingly, where three rotatable casters and two fixed casters are mounted on the bottom case 1 as shown in FIG. 10, three caster mounting members 31 having stoppers 32, and two caster frame 31*a* are integrally formed at the bottom case 1, and three casters having frames and two casters are coupled to the corresponding caster mounting members 31 and caster frames 31*a*.

Figure 12:
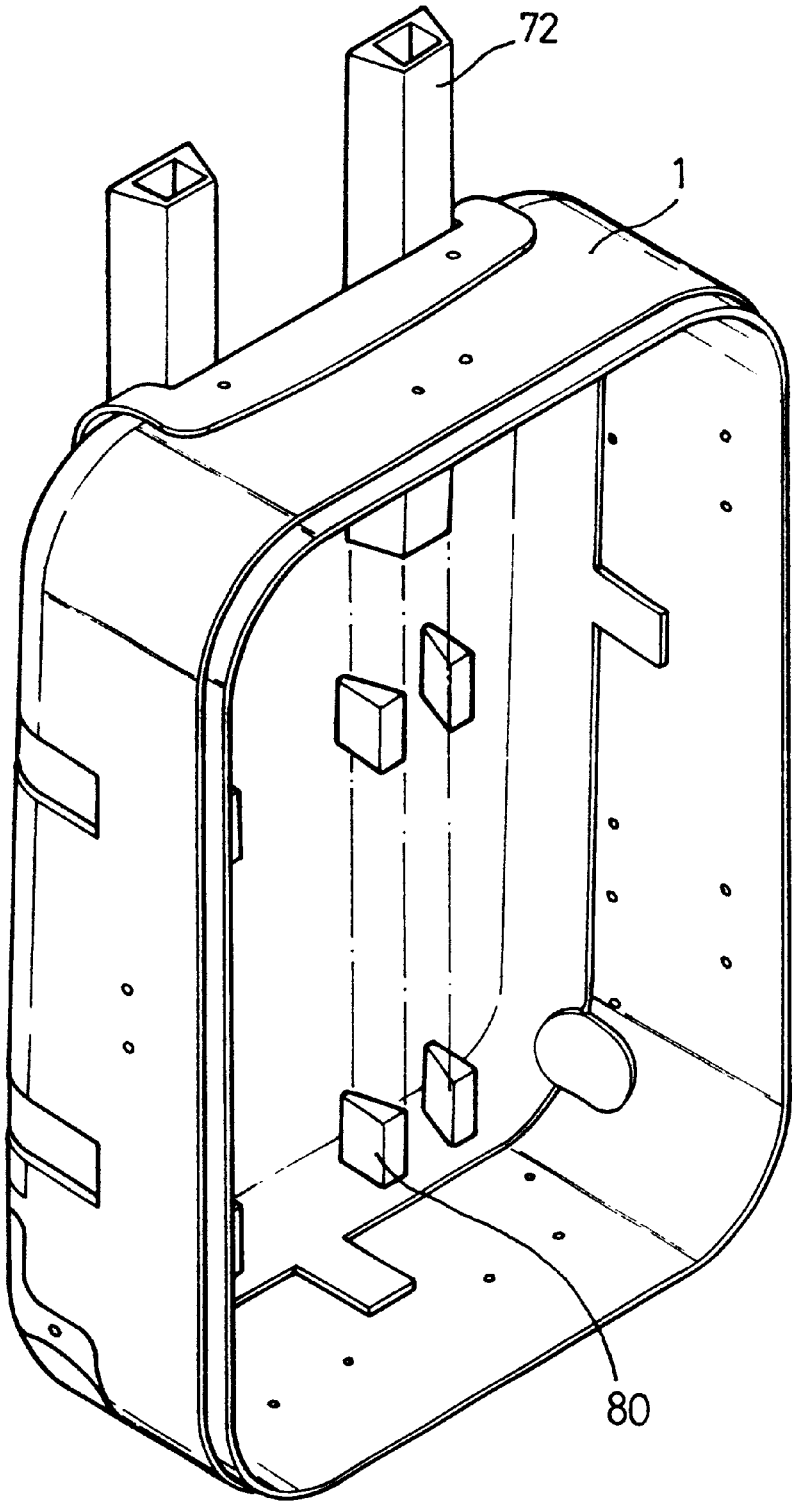
FIG. 12 is a perspective view showing a bottom case, at an inner surface of which handle holding projections and handle holding pipe sections are provided.

4. Installation of an Extensible Handle 7 to a Bottom Case 1 (See FIGS. 11 to 13)

In a first embodiment, square pipe segments are injection molded together with the bottom case 1. To improve design and functionality of the bag, each of the square pipe segments is opened at its outer face, and becomes narrow toward the outer side, so that the extensible handle 7 is attached to an outer surface of the bottom case by being received in the square pipe segments (see FIG. 11).

Alternatively, the bottom case 1 is formed at its front side wall with handle holes 73, and is integrally formed at its inner surface with a plurality of square pipe segments similar to those of FIG. 11. The extensible handle 7 is inserted into the square pipe segments through the handle holes 73 (not shown).

In a second embodiment, the bottom case 1 is formed at its front side wall with handle holes 73, and is integrally formed at its inner surface with a plurality of pairs of holding projections 80. Each pair of holding projections are positioned such that a spacing defined between outer ends thereof is more narrow than a spacing defined between root ends. Therefore, although the extensible handle 7 is simply inserted between the pairs of holding projections 80, the handle 7 is hardly separated from the holding projections 80 (see FIG. 12).

In a third embodiment, the handle holes 73 are formed at a front side wall of the bottom case as in the above described embodiment. The bottom case 1 is formed at both sides of a lateral middle line and at both sides of a rear end with handle holder holes 78*a* and 78*b*. Screw holes 78*c* are formed at the bottom case 1 such that they are positioned between the pair of handle holder holes 78*a* and between the pair of handle holder holes 78*b*, respectively. Handle holder bars 78 and 79 are attached to the bottom case 1 such that projected holders integrally formed at opposite ends thereof are inserted into the pairs of handle holder holes 78*a* and 78*b*. Each of the projected holders becomes narrow toward its outer end. The handle holder bars 78 and 79 are fixedly attached to the bottom case 1 by tightening screws through the screw holes 78*c*. Thereafter, the extensible handle 7 is inserted the projected holders of the handle holder bars 78 and 79 through the handle holes 73 (see FIG. 13).

As described above, a bag with a bottom case according to the present invention has advantages as follows.

Since a bottom case and an upper case of the bag are coupled to each other by a slide fastener, and binding strips are connected to the bottom and upper cases to share load acting on the slide fastener, when any one of the bottom case and the upper case is broken or dirtied, the case can be easily separated from the matching case to afford replacement or cleaning of the case.

Although a side wall of the bottom case is shaped to have a relatively larger height, the side wall of the bottom case is backed by a reinforcing frame so that the side wall is hardly deformed or broken. Accordingly, a production process of the bag is more simplified than that of a conventional bag, thereby improving productivity.

Since caster mounting members incorporating stoppers therein or caster frames are integrally formed with a bottom case without mounting of separately produced stoppers on the bottom case, and corresponding casters are coupled to the caster mounting members or the caster frames, a production process of the bottom case can be simplified, thereby improving productivity and reducing production cost.

In addition, since handle holding members can be integrally formed at any one of an outer surface of the bottom case and an inner surface of the bottom case in various ways, the bag can exhibit various appearances and functionalities according to an application of the bag.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A bag comprising:

a bottom case including a handle holding member, a caster mounting member and a side wall of a certain height, all of which are integrally formed therewith;

an extensible handle adapted to be held by the handle holding member;

two or more casters coupled to the caster mounting member;

an upper case detachably coupled to the bottom case by means of a slide fastener;

a plurality of protruded wall portions provided on an inner surface of said bottom case, said protruded wall portions extending partly up said side wall such that an upper end surface of each protruded wall portion against said side wall forms a fitting groove; and a reinforcing frame fitted within said bottom case in abutment with said side wall and resting upon said fitting grooves to provide reinforcement to said bottom case.

2. The bag as set forth in claim 1, further comprising a binding strip connected at its opposite ends to the bottom case and the upper case so as to share load acting on the slide fastener.

3. The bag as set forth in claim 1, wherein said reinforcing frame is made of metal or synthetic resin and has a plurality of holes therein, the reinforcing frame being fixedly attached to the side wall by means of screws.

4. The bag as set forth in claim 3, in which the reinforcing frame is provided with a reinforcing sub-frame and a partition so as to improve structural stability of the reinforcing frame and to provide various receiving spaces.

5. The bag as set forth in claim 1, in which the handle holding member is a polygonal pipe segment having an opened outer surface portion.

6. The bag as set forth in claim 5, in which the caster mounting member is integrally formed with a stopper and provided at an outer surface of the bottom case, and the bottom case is integrally formed at its outer surface with a caster frame.

7. The bag as set forth in claim 5, in which the handle holding member is integrally formed at an inner surface of the bottom case.

8. The bag as set forth in claim 1, in which a front side wall of the bottom case is formed with handle holes, and the bottom case is formed at both sides of a lateral middle line and at both sides of a rear end with front and rear pairs of handle holder holes, wherein the bottom case is formed with screw holes such that the screw holes are positioned between the front pair of handle holder holes and between the rear pair of handle holder holes, respectively.

9. A bag comprising:

a bottom case including handle holding members, caster mounting members and a side wall of a certain height, all of which are integrally formed therewith;

an extensible handle adapted to be held by the handle holding members;

two or more casters coupled to the caster mounting members; and an upper case detachably coupled to the bottom case by means of a slide fastener;

each of said handle holding members being a polygonal pipe segment with an opened outer surface portion, a spacing defined between the opened ends being smaller than a spacing defined between root walls thereof.

10. The bag as set forth in claim 9, wherein the handle holding members are integrally formed at an inner surface of the bottom case.

11. The bag as set forth in claim 9, further comprising:

a plurality of protruded wall portions provided on an inner surface of said bottom case, said protruded wall portions extending partly up said side wall such that an upper end surface of each protruded wall portion against said side wall forms a fitting groove; and a reinforcing frame fitted within said bottom case in abutment with said side wall and resting upon said fitting grooves to provide reinforcement to said bottom case.

12. The bag as set forth in claim 11, wherein said reinforcing frame is made of metal or synthetic resin and has a plurality of holes therein, the reinforcing frame being fixedly attached to the side wall by means of screws.

13. A bag comprising:

a bottom case including handle holding members, caster mounting members and a side wall of a certain height, all of which are integrally formed therewith;

an extensible handle adapted to be held by the handle holding members;

two or more casters coupled to the caster mounting members; and an upper case detachably coupled to the bottom case by means of a slide fastener;

a front side wall of the bottom case being formed with handle holes, and the bottom case being formed at both sides of a lateral middle line and at both sides of a rear end with front and rear pairs of handle holder holes, said bottom case being formed with screw holes positioned between the front pair of handle holder holes and between the rear pair of handle holder holes, respectively.

14. The bag as set forth in claim 13, further comprising:

a plurality of protruded wall portions provided on an inner surface of said bottom case, said protruded wall portions extending partly up said side wall such that an upper end surface of each protruded wall portion against said side wall forms a fitting groove; and a reinforcing frame fitted within said bottom case in abutment with said side walls and resting upon said fitting grooves to provide reinforcement to said bottom case said reinforcing frame being made of metal or synthetic resin and fixedly attached to the side wall.

* * * * *